US006074242A

United States Patent [19]

Stefaniu et al.

[11] Patent Number: 6,074,242

[45] Date of Patent: Jun. 13, 2000

[54] WIRE-TRAP CONNECTOR FOR SOLDERLESS COMPRESSION CONNECTION

[75] Inventors: Michael V. Stefaniu, Lake Zurich; Charles A. Kozel, McHenry, both of Ill.

[73] Assignee: Methode Electronics, Inc., Chicago, Ill.

[21] Appl. No.: 09/224,611

[22] Filed: Dec. 31, 1998

[51] Int. Cl.[7] ..... H01R 4/24; H01R 4/26; H01R 11/20

[52] U.S. Cl. ..... 439/441

[58] Field of Search ..... 439/441

[56] References Cited

U.S. PATENT DOCUMENTS 4,978,315 12/1990 Edgley ..... 439/441

5,110,305 5/1992 Edgley ..... 439/441

5,494,456 2/1996 Kozel et al. ..... 439/441

*Primary Examiner*—Lincoln Donovan

*Assistant Examiner*—Javaid Nasri

*Attorney, Agent, or Firm*—Karl D. Kovach; David L. Newman

[57] ABSTRACT

A wire trap connector provides an adjustably mounted compression tail which protrudes from a contact within a housing of the wire trap connector. The compression tail is oriented at a right angle to one side of the connector housing or extends perpendicular from the connector housing. The invention thus allows a means of attaching wires to an electronic assembly without soldering the connector to the PCB. This provides the benefit of eliminating the soldering process from manufacturing. In addition, the compression tail offers alternate circuit assembly options to be used without the addition of a wave solder or manual solder step. Thus, the invention offers a significant cost reduction compared to current technology.

20 Claims, 5 Drawing Sheets

WIRE-TRAP CONNECTOR FOR SOLDERLESS COMPRESSION CONNECTION

TECHNICAL FIELD

The present invention relates to a wire-trap connector.

BACKGROUND OF THE INVENTION

Wire-trap connectors are used for making an electrical connection between an external electrical wire, having a stripped distal end exposing the conductor, and a wire clamping electrical contact located within the connector. Normally, in order to make an electrical connection between the conductor and the clamping contact, the stripped end of the wire is inserted within a wire insertion opening located on the outside of the wire-trap connector. Once the wire is inserted within the connector, the wire clamping electrical contact forms an electrical connection with the wire and prevents the wire's extraction from the connector without the use of a wire extraction tool.

U.S. Pat. No. 5,494,456 claims a wire-trap connector with an over-stress feature on a contact beam. The connector is soldered to a printed circuit board by means of a contact solder tail which is soldered by means of a through-hole in the printed circuit board. Circuit boards constructed with through-holes allow the connector to be wave soldered to a printed circuit. This through-hole connection requires additional steps and board costs when surface reflow mounting is the primary assembly process. In a new fixture, the opportunity to have through-holes is eliminated to achieve three goals in the assembly—smaller, cheaper, and more aesthetically pleasing. Any components of the assembly attachable to circuit board by through-holes defeats these three goals. Of the wire trap connectors contending for use in the new fixture, the wire-trap connector described in U.S. Pat. No. 5,494,456 is thus eliminated. The level of precision in the process of attaching circuit elements is not the same for wave soldering as it is for reflowing. Moreover, any use of that wire-trap connector in the new assembly would take away the cost advantages of the new assembly because of the need for wave soldering a wire-trap connector in an assembly whose other components are reflowable. This is true because separate connection techniques are needed—wave soldering and reflowing—rather than one.

In view of the above, it is an object of the invention to provide a compression mountable wire-trap connector.

It is a further object to avoid a wave soldering step in the manufacture of a wire trap connector.

In addition, it is an object of the invention to make a wire trap connector that needs no through holes in a printed circuit board.

It is also an object of the invention to provide for a wire trap connector that may be secured to a printed circuit board by the same means—whether by reflow, wave soldering or other means—as other circuit elements for attachment to the printed circuit board.

SUMMARY OF THE INVENTION

According to the present invention, a wire trap connector provides an adjustably mounted compression tail which protrudes from a contact within a housing of the wire trap connector. The compression tail is oriented at a right angle to one side of the connector housing or extends perpendicular from the connector housing. The invention thus allows a means of attaching wires to an electronic assembly without soldering the connector to the PCB. This provides the benefit of eliminating the soldering process from manufacturing. In addition, the compression tail offers alternate circuit assembly options to be used without the addition of a wave solder or manual solder step. Thus, the invention offers a significant cost reduction compared to current technology.

In one form of the invention, a wire-trap connector protects a connector's contact from becoming overstressed. The wire-trap connector housing has a connection passageway for providing access to the contact mounted within the connector. In addition, the connector housing has a release passageway, located separately from the connection passageway, which provides access to the contact. When a wire extraction tool is inserted within the release passageway it presses against the contact and causes release of a wire from the connector. During release of the wire from the connector, the contact has at least one tab projecting from it which will abut against an overstress stop abutment mounted within the connector housing. The restricted travel of the contact during the release of the wire will prevent the contact from being permanently deformed.

Further, the invention provides a molded omit that covers the connection passageway located within the connector housing. Further, the invention provides for a channel located in the connector housing. Further, the overstress stop abutment and/or the release stop abutment are contained within the channel. Further, the invention provides for the contact to be retained in the connector housing via a friction fit. Further, the invention provides that none of the surfaces of the contact be exposed externally of the connector housing.

Other objects, features and advantages will become apparent in light of the text and drawings describing the invention.

DETAILED WRITTEN DESCRIPTION OF PRESENTLY PREFERRED EMBODIMENTS OF THE INVENTION

Figure 1:
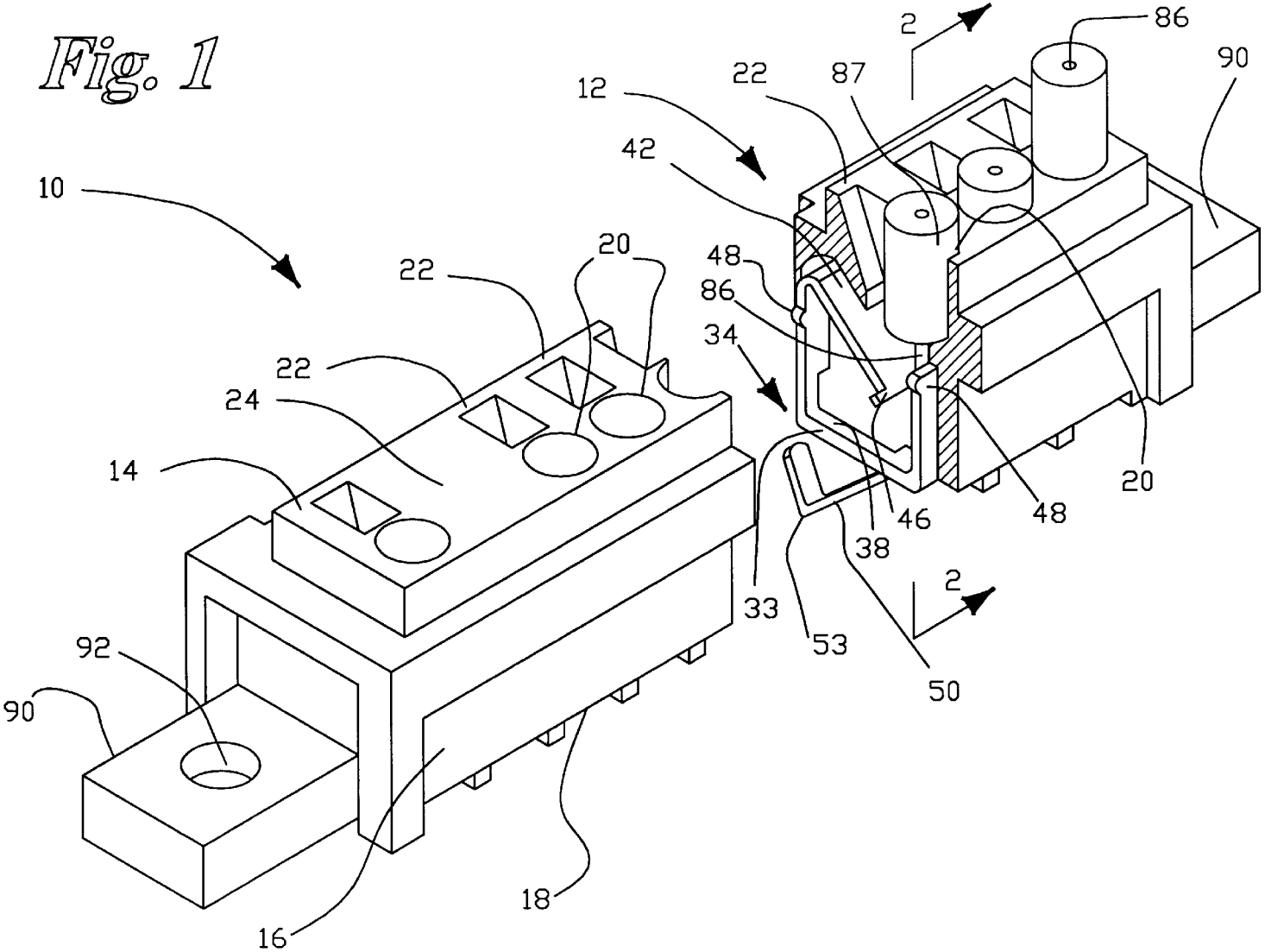
FIG. 1 is an enlarged fragmentary perspective view of a wire-trap connector assembly exposing a connector chamber having an external wire inserted within the chamber.

In FIG. 1, a fragmentary view of a wire-trap connector 10 is shown with one of its connector chambers 12 exposed. The wire-trap connector 10 is generally rectangular in shape with a first side 14, a second side 16 located adjacent to the first side 14, and a third side 18 which is opposite the first side. There is also a fourth side 23.

The third side 18 of the wire-trap connector assembly 10 is uncovered and allows access to the bottom of each of the connector chambers 12. The uncovered third side 18 allows for insertion of contacts 34 therethrough, which are secured within the housing via a frictional fit.

Conversely, the first side 14 of the wire-trap connector 10 has a plurality of wire insertion openings 20 and wire release openings 22 which are grouped into pairs. Generally, each of the wire insertion opening 20 and wire release opening 22 pairs are positioned at an equal distance from each other. In a preferred embodiment, three (3) to ten (10) pairs of wire insertion openings and wire release openings are present on the connector 10.

To facilitate keying of the connector 10, an omit 24 may be provided on the first side 14 of the connector. The omit 24 consists of a region where normally a wire insertion opening 20 would be provided, but instead the opening has been eliminated.

Within the connector assembly 10 are a plurality of connector chambers 12 (only one connector chamber is shown in FIG. 1). Each of the wire insertion openings 20 and wire release openings 22 provides access to a single connector chamber 12. Wire 86 is received into the chamber 12 and protrudes from the first side 14 with wire insulation 87.

Figure 2:
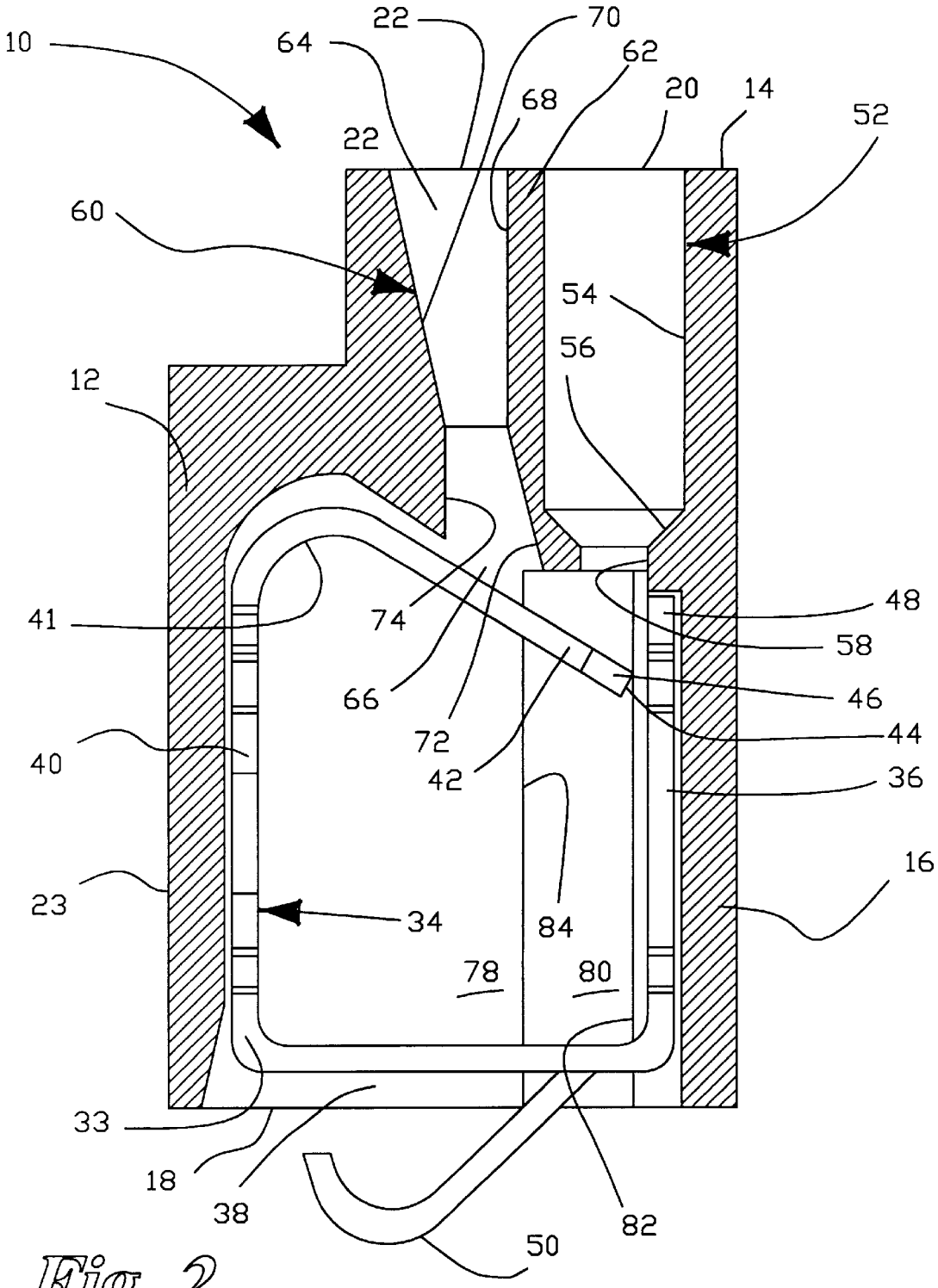
FIG. 2 is an enlarged cross-sectional side view of the wire-trapping connector chamber depicted in FIG. 1, taken at line 2—2, with the external wire removed.

Mounted inside each connector chamber 12 is a contact 34 which clamps electrically. Referring to FIG. 2, each clamping electrical contact 34 has a main electrical contact 36 mounted adjacent to the second side 16 of the connector 10. Each clamping electrical contact 34 also has a bottom plate 38 which runs along the third side 18 of the connector with one end of the plate connected to the main electrical contact 36 and the other end connected to a side arm 40. The side arm 40 parallels the main electrical contact 36 and connects to a clamping arm 42. The region where the clamping arm 42 connects to the side arm 40 forms a flexible joint 41 which is generally U-shaped. In addition, the clamping arm 42 has a first distal end 44 which is opposite the end connected to the side arm 40.

Located on both sides of the first end 44 of the clamping arm 42 are two tabs 46 (only one tab is shown in FIG. 2). Referring back to FIG. 1, located on both sides of the clamping electrical contact 34 are mounting ears 48 which facilitate the mounting of the clamping electrical contact to the connector 10. The mounting ears 48 provide a friction fit of the contact 34 within the chamber 12. The shape of the contact 34 allows it to be secured within the chamber 12 without any members of the contact 34 having to protrude or be exposed externally to the housing which in prior connectors has caused shorting problems. The connector 10 is preferably constructed of a polyester 94V-0 material which is 15% glass-filled. In addition, it is preferred that the clamping electrical contact 34, including the tabs 46 and mounting ears 48 are a unitary structure stamped and formed of metal material such as phosphor bronze contacts with tin plating.

Contact 34 has four sides. Thus, contact 34 within the chamber 12 has a first contact side which is main contact 36; it is parallel the direction of insertion of said wire conductor 86 into said wire-trap connector 10. Contact 34 has a second contact side 33 along side 18 from which a compression tail 50 extends away from said housing. Contact 34 has a third contact side which is main side arm 40 opposite said first contact side (main contact 36). Contact 34 has a fourth contact side which is clamping arm 42 for clamping wire conductor 86 against said first side 36.

Figure 5:
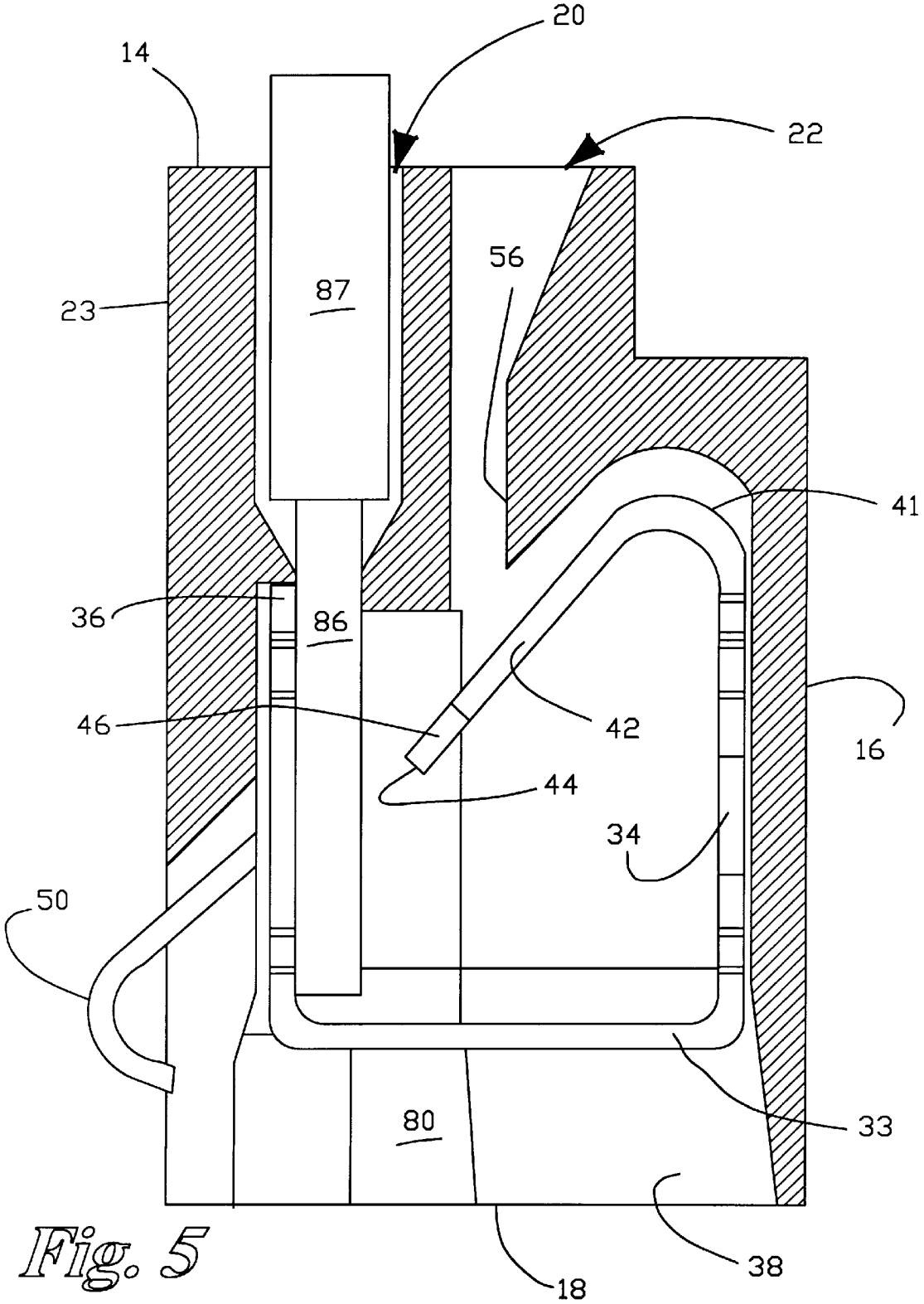
FIG. 5 is an enlarged cross-sectional view of an alternate embodiment of the connector of the present invention.

In one embodiment, the clamping contact 34 is stamped and formed of a single piece of metal material and the compression tail 50 is also stamped and formed so that it will protrude from the connector in an adjustable, compressible manner. For example, FIG. 1 depicts the compression tail 50 projecting from the side 18 of the connector 10 to provide for vertical mounting of the connector. Similarly, FIG. 5 shows the compression tail 50 projecting from electrical contact 36 directly from the fourth side 23 of the connector 10 to provide for right angle mounting.

For mounting the connector 10, board-mounting ears 90 are positioned on the ends of connector 10. Board-mounting ears 90 are pierced with holes 92 for allowing securing means such as a screw or bolt for securing connector 10 to a circuit board. Alternatively, holes 92 need not be there but rather the connector 10 can be secured to a PCB by adhesive between unholed ears 90 and the PCB. It will be apparent to those skilled in the art that there are other equivalent means of securing connector 10 to a PCB.

Turning back to FIG. 2, the wire insertion opening 20 provides access to the connector chamber 12 by way of a connection passageway 52. The connection passageway 52 consists of a cylindrically shaped wire insertion bore 54, a conical shaped wire guide 56, and a conductor collar 58. One end of the wire insertion bore 54 forms the wire insertion opening 20 and the other end of the bore couples to the small open end of the wire guide 56. The small open end of the wire guide 56 connects to the conductor collar 58. The conductor collar 58 is generally cylindrical in shape and opens into the connector chamber 12. The conductor collar 58 ensures that any conductor inserted into the connector chamber 12 will be positioned adjacent to the main electrical contact 36 of the clamping contact 34. In addition, the diameter of the conductor collar 58 limits the size of the wire 86 which can be inserted into the connector chamber 12 and prevents the non-stripped insulation 87 of the wire from entering the chamber 12.

Similarly, the wire release opening 22 provides access to the connector chamber 12 by way of a release passageway 60. The release passageway 60 is separated from the connection passageway 52 by a partition 62. The release passageway 60 consists of a guide bore 64 and a restrictive bore 66. The guide bore 64 is defined by a separation wall 68 and a sloped guide wall 70. The separation wall 68 parallels the wire insertion bore 54 on the other side of the partition 62. In addition, the sloped guide wall 70 angles towards the separation wall 68 as it approaches the opening of the restrictive bore 66.

Likewise, the restrictive bore 66 adjoins the guide bore 64 and is defined by a sloped restriction wall 72 and a back-pressure wall 74. The back-pressure wall 74 adjoins the sloped guide wall 70, slants towards the center of the connector chamber 12, and extends to the connector chamber 12. Similarly, the sloped restriction wall 72 adjoins the separation wall 68, angles away from the back-pressure wall 74, and extends to the connector chamber 12.

On both sides of each connector chamber 12 are side walls 78 (only one side wall is shown). Etched within each side wall 78 is a channel 80. Each channel 80 faces the channel located in the opposite side wall 78 and the two sides of the channel 80 are formed by a release stop abutment 82 located adjacent to the main electrical contact 36 and an overstress stop abutment 84 located opposite to the release stop abutment 82 (See FIG. 3).

Figure 3:
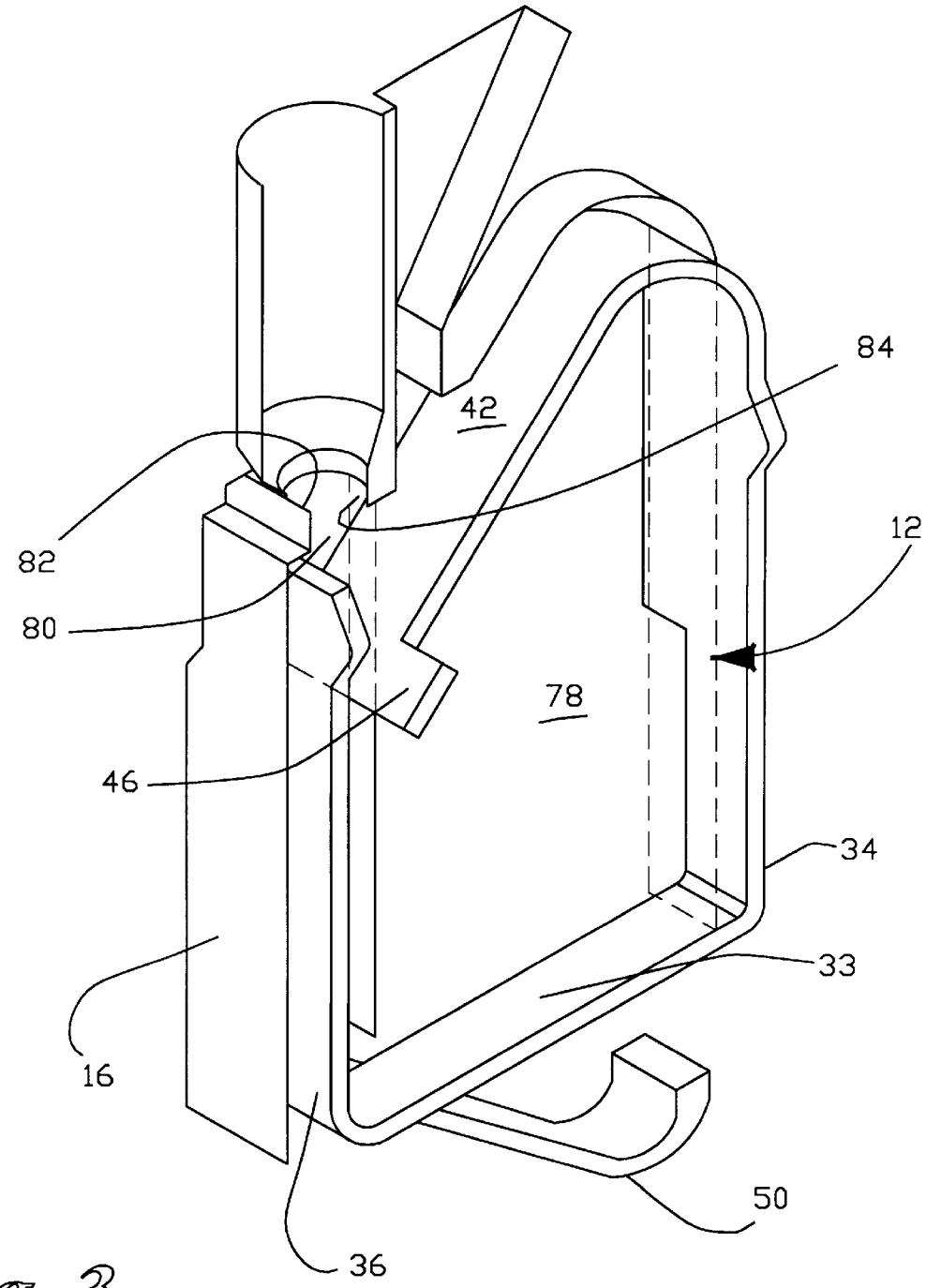
FIG. 3 is a further enlarged schematic view of the wire clamping contact mounted within the connector chamber depicted in FIG. 2.

Turning to FIG. 3, each tab 46 on the clamping arm 42 resides within the channel 80 etched in each of the side walls 78 surrounding the connector chamber 12. As depicted by FIG. 2, with the tab 46 located in the channel 80 of the side wall 78, the travel of the clamping arm 42 is restricted. When no wire is inserted within the connector chamber 12, each tab 46 abuts its corresponding release stop abutment 82. Conversely, when the clamping arm 42 is compressed, it cannot travel past the overstress stop abutment 84 because each tab 46 will abut its corresponding overstress stop abutment 84.

In its manufacturing, compression tail 50 is made from the same metal blank as the entire contact 34. Compression tail 50 is partially cut from that metal blank as shown in FIG. 3 by the cut-out in contact 34 opposite side 16. Compression tail 50 begins near side 16 and wire 86 and juts linearly at an angle which is obtuse to main electrical contact 36 but pointing in the opposite sense to clamping arm 42 which begins near flexible joint 41 and terminates in tabs 46. In an alternative embodiment shown in FIG. 5, compression tail 50 begins near side 16 and wire 86 and juts linearly at an angle which is obtuse to main electrical contact 36 but pointing in the same sense to clamping arm 42 which begins near flexible joint 41 and terminates in tabs 46. Compression tail 50 terminates in a bend toward passageway 12 to form an overall "J" shape of compression tail 50. As shown in FIG. 5, clamping arm 42 and the linear portion of compression tail 50 are parallel one another. For ease of manufacturing, in one embodiment comporting more closely to that of FIG. 4 than FIG. 5, the linear portion of tail 50 is perpendicular to clamping arm 42 (though not perpendicular at the same vertex). Compression tail 50 terminates in a bend toward passageway 12, in both FIGS. 4, 5. As shown, compression tail 50 is in the same sense as the direction of insertion of wire 86. It will be appreciated by those skilled in the art that it could have an opposite sense to wire 86. Compression tail 50 thus has a flat portion which extends from the flat portion of said contact 34, terminating in a bent portion such than an elbow 53 of said bent portion may make electrical contact with a trace of a circuit for passing electricity between said trace and wire conductor 86.

In order to make an electrical connection between the wire clamping electrical contact 34 and an external wire, the exposed conductor of the wire must be inserted within the wire insertion opening 20. As the wire conductor 86 is pushed further into the connection passageway 52, the conductor portion of the wire will pass through the wire insertion bore 54 and be directed by the wire guide 56 into the conductor collar 58. Once the wire 86 enters the connector chamber 12, it will abut the clamping arm 42 as shown in FIG. 1. As the wire 86 is pushed even further into the connection chamber 12, the clamping arm 42 will be pushed down and away from the release stop abutment 82. The travel of the wire 86 will finally be stopped once it abuts the bottom plate 38 of the wire clamping electrical contact 34.

In order to form a firm electrical connection between the clamping contact 34 and the wire conductor 86, the compressed clamping arm 42 of the wire clamping electrical contact 34 will firmly push the wire against the main electrical contact 36. Furthermore, the clamping contact 34 will pinch the wire 86 between the clamping arm 42 and the main electrical contact 36 in order to prevent the removal of the wire from the connector 10. The sharp edge of the first end 44 of the clamping arm 42 bites against the wire 86 to prevent it from being removed.

Figure 4:
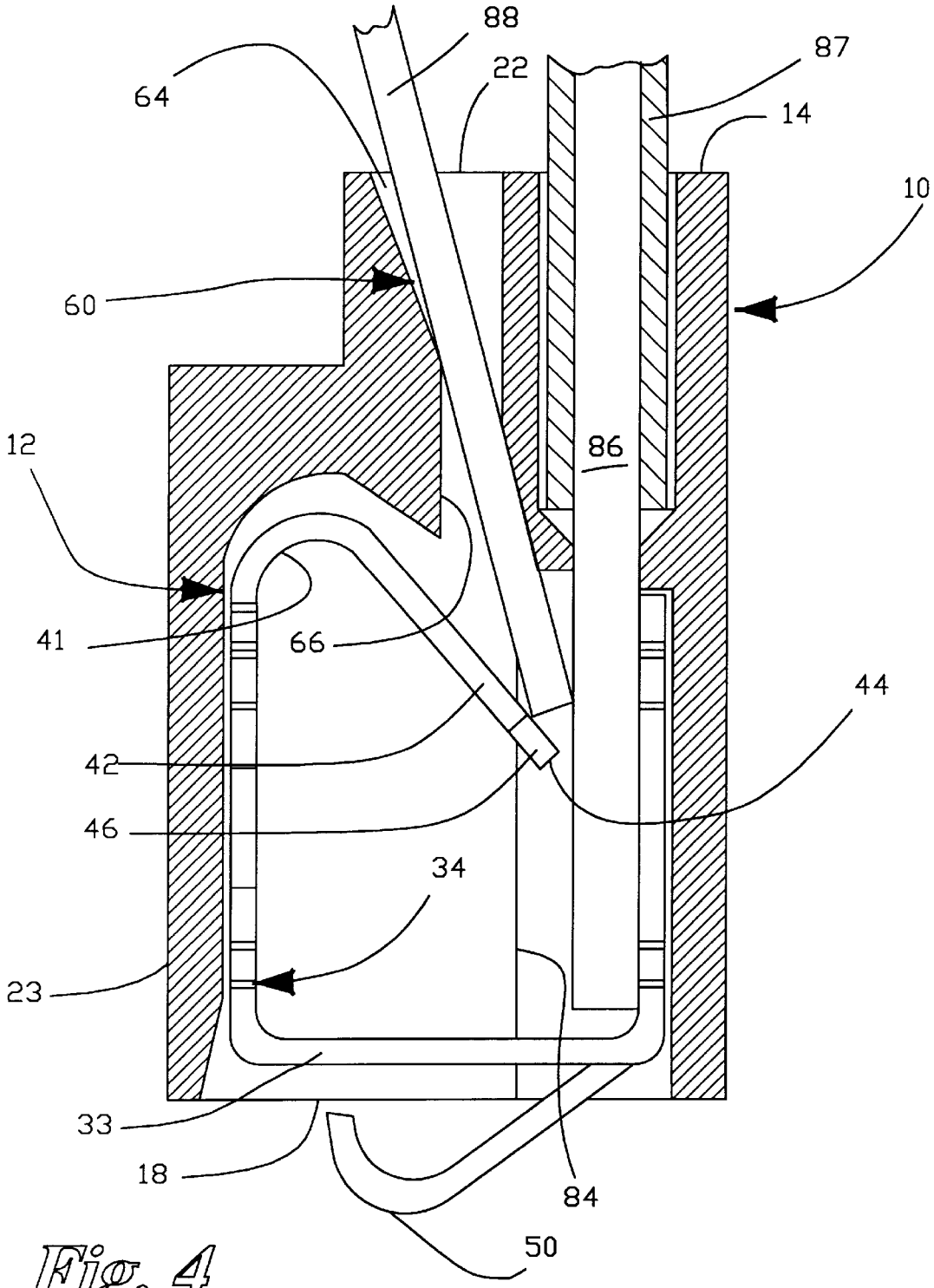
FIG. 4 is an enlarged cross-sectional side view of the wire-trapping connector chamber depicted in FIG. 1, taken at line 2—2, but with a wire extraction tool inserted into the chamber.

As shown in FIG. 4, to release the clamping contact's 34 grip on the wire 86, a wire extraction tool 88 is used. The wire extraction tool 88 is generally cylindrical in shape and is inserted within the wire release opening 22. As the wire extraction tool 88 is pushed further into the release passageway 60, the tool will be directed by the guide bore 64 into the restrictive bore 66. As the tool 88 is pushed further into the connector chamber 12, it will abut the clamping arm 42. The tool 88 will push on the clamping arm 42, which will cause the arm to compress and release its pinching grip on the wire 86.

During the wire release process, however, the clamping arm 42 will be prevented from being overstressed. When the clamping arm 42 is being forced away from the wire 86, each of the tabs 46 on the clamping arm 42 will abut its overstress stop abutment 84 which will prevent the arm from being compressed so much that it becomes permanently deformed.

Furthermore, the wire extraction tool 88 enters the connector chamber 12 and engages with the clamping arm 42 at a converging angle which prevents the sharp edge of the first end 44 of the clamping arm 42 from grasping onto the tool 88.

The positioning and shape of the guide bore 64 and the restrictive bore 66 of the release passageway 60 also allows for effective electrical testing of both the wire clamping electrical contact 34 and the electrical wire 86. If a conductive test probe, or wire extraction tool, is inserted within the connector chamber 12, the probe can be positioned so that it will only form an electrical connection with the wire clamping electrical contact 34, or, alternatively, the probe can be positioned so that it can test both the contact 34 and the wire 86 together.

The invention provides an adjustably mounted compression tail 50 which protrudes from the contact 34. The invention thus allows a means of attaching wires to an electronic assembly without soldering the connector to a printed circuit board (PCB). By merely attaching the connector 10 to a PCB, compression tails 50 contact traces on the PCB. This provides the benefit of eliminating the soldering process from manufacturing. In addition, the compression tail 50 offers alternate circuit assembly options to be used such as flex circuitry without the addition of a wave solder or manual solder step. Thus, the invention offers a significant cost reduction compared to current technology.

FIG. 5 shows an embodiment which is alternative to that in FIG. 1. Compression tail 50 projects from side 23 rather than side 18 for allowing wire 86 to be parallel to any circuit board to which connector 10 would be attached. In that event, board-mounting ears 90 (FIG. 1) would be rotated clockwise 90 degrees (about an axis along the length of connector 10).

It should be understood that various changes and modifications to the presently preferred embodiments described herein will be apparent to those skilled in the art. Such changes and modifications may be made without departing from the spirit and scope of the present invention and without diminishing its attendant advantages. It is, therefore, intended that such changes and modifications be covered by the appended claims.

What is claimed is:

1. A wire-trap connector for forming an electrical connection between a wire conductor trapped in said wire-trap connector and an electrical circuit formed on a surface of a printed circuit board, said wire-trap connector comprising:

a contact for clamping said wire conductor and connecting to said electrical circuit; and a connector housing having a channel and containing said contact, and wherein said contact includes a flat portion and is shaped from a stamped piece of flat conductive material and further includes an adjustably mounted compression tail having a flat portion which extends from said flat portion of said contact and terminating in a bent portion so that an elbow of said bent portion being solderlessly, electrically contactable and adjustably compression mountable with a trace of said electrical circuit for passing electricity between said trace and said conductor, and wherein said trace, in a region of contact between said trace and said elbow, exists on the surface of the printed circuit board and does not extend through a thickness of the printed circuit board as a through-hole.

2. The wire-trap connector of claim 1, wherein said contact within said housing has a first side parallel to a direction of insertion of said wire conductor into said wire-trap connector, a second side from which said compression tail extends away from said housing, a third side opposite said first side, and a fourth side which functions as a clamping arm for clamping said wire conductor against said first side.

3. The wire-trap connector of claim 1, further including an overstress prevention means on a wall of said channel for interacting with the contact, whereby said contact is prevented from being overstressed when said wire is released from said contact, and wherein said overstress prevention means comprises at least one overstress stop abutment which limits movement of said contact.

4. The wire-trap connector of claim 1, further comprising testing access means associated with said housing for allowing testing of said electrical connection between said wire conductor and said contact.

5. The wire-trap connector of claim 4, wherein said testing access means comprises:

a connection passageway for providing access to said contact so that said wire can be inserted within said connector and trapped by said contact; and a release passageway, located separate from said connection passageway, for providing access to said contact in order to release said wire.

6. The wire-trap connector of claim 1, wherein said compression tail is oriented in a direction that is the same as a direction of insertion of the wire into said wire-trap connector.

7. The wire-trap connector of claim 1, wherein said compression tail is oriented in a direction perpendicular to a direction of insertion of the wire into said wire-trap connector.

8. The wire-trap connector of claim 1, further comprising securing means for securing the wire-trap connector to the printed circuit board so as to maintain contact between the elbow and the trace.

9. The wire-trap connector of claim 8 wherein the securing means comprises at least one board-mounting ear connected to the connector housing, and wherein the at least one board-mounting ear has a hole.

10. An electrical connector comprising:

a) a wire clamping electrical contact for grasping onto a wire, said wire clamping electrical contact having an adjustably mounted compression tail having a flat portion which extends from a flat portion of said wire clamping electrical contact and terminating in a bent portion so that an elbow of said bent portion being solderlessly, electrically contactable and adjustable compression mountable with a trace of a circuit for passing electricity between said trace and said conductor, and wherein the circuit exists on a surface of a printed circuit board, and wherein said trace, in a region of contact between said trace and said elbow, exists on the surface of the printed circuit board and does not extend through a thickness of the printed circuit board as a through-hole;

b) a connector housing with said wire clamping electrical contact mounted within, and said connector housing having:

i) a connection passageway for providing access to said wire clamping electrical contact so that said wire can be inserted within said connector and trapped by said wire clamping electrical contact, ii) a release passageway, located separate from said connection passageway, for providing access to said wire clamping electrical contact in order to release said wire, and iii) a channel within said connector housing; and c) at least one tab projecting from said wire clamping electrical contact; and d) at least one overstress stop abutment associated with said channel, the at least one tab abuts the at least one overstress stop abutment during a release of said wire from said wire clamping electrical contact.

11. The electrical connector of claim 10, including a molded omit so as to facilitate keying.

12. The electrical connector of claim 11, wherein said molded omit covers said connection passageway.

13. The electrical connector of claim 10, wherein said wire clamping electrical contact within said housing has a first side parallel to a direction of insertion of said wire conductor into said wire-trap connector, a second side from which said compression tail extends away from said housing, a third side opposite said first side, and a fourth side which functions as a clamping arm for clamping said wire conductor against said first side.

14. The electrical connector of claim 10, further comprising securing means for securing the electrical connector to the printed circuit board so as to maintain contact between the elbow and the trace.

15. The electrical connector of claim 14, wherein the securing means comprises at least one board-mounting ear connected to the connector housing, and wherein the at least one board-mounting ear has a hole.

16. An electrical connector comprising:

a) a wire clamping electrical contact for grasping onto a wire, said wire clamping electrical contact shaped from a stamped piece of flat conductive material and further includes an adjustably mounted compression tail having a flat portion which extends from a flat portion of said wire clamping electrical contact and terminating in a bent portion so that an elbow of said bent portion being solderlessly, electrically contactable and adjustable compression mountable with a trace of a circuit for passing electricity between said trace and said conductor, and wherein the circuit exists on a surface of a printed circuit board, and wherein said trace, in a region of contact between said trace and said elbow, exists on the surface of the printed circuit board and does not extend through a thickness of the printed circuit board as a through-hole;

b) a connector housing with said wire clamping electrical contact mounted within, and said connector housing having:

i) a connection passageway for providing access to said wire clamping electrical contact so that said wire can be inserted within said connector and trapped by said wire clamping electrical contact, ii) a release passageway, located separate from said connection passageway, for providing access to said wire clamping electrical contact in order to release said wire, and iii) a channel within said connector housing; and c) at least one tab projecting from said wire clamping electrical contact.

17. The electrical connector of claim 16, further including at least one overstress stop abutment associated with said channel, the at least one tab abuts the at least one overstress stop abutment during a release of said wire from said wire clamping electrical contact, and wherein said channel includes a release stop abutment therein.

18. The electrical connector of claim 16, wherein said wire clamping electrical contact within said housing has a first side parallel to a direction of insertion of said wire conductor into said electrical connector, a second side from which said compression tail extends away from said housing, a third side opposite said first side, and a fourth side which functions as a clamping arm for clamping said wire conductor against said first side.

19. The electrical connector of claim 16, further comprising securing means for securing the electrical connector to the printed circuit board so as to maintain contact between the elbow and the trace.

20. The electrical connector of claim 19, wherein the securing means comprises at least one board-mounting ear connected to the connector housing, and wherein the at least one board-mounting ear has a hole.

* * * * *